US005138330A

United States Patent [19]

Lindenmeier et al.

[11] Patent Number: 5,138,330

[45] Date of Patent: Aug. 11, 1992

[54] PANE ANTENNA HAVING AN AMPLIFIER

[75] Inventors: Heinz Lindenmeier, Planegg; Gerhard Flachenecker, deceased, late of Ottobrunn, by Hildegard Flachenecker, heiress; Jochen Hopf, Haar; Leopold Reiter, Gilching, all of Fed. Rep. of Germany

[73] Assignee: Hans Kolbe & Co. Nachrichtenübertragungstechnik, Zalzdetfurth, Fed. Rep. of Germany

[21] Appl. No.: 490,767

[22] Filed: Mar. 8, 1990

[30] Foreign Application Priority Data

Mar. 8, 1989 [DE] Fed. Rep. of Germany ..... 3907493

[51] Int. Cl.[5] ..... H01Q 1/320; H01Q 23/000

[52] U.S. Cl. ..... 343/713; 343/701

[58] Field of Search ..... 343/713, 711, 712, 701, 343/850; 455/291, 292, 293

[56] References Cited

U.S. PATENT DOCUMENTS

| | | | |
|---|---|---|---|
| 3,866,232 | 2/1975 | Weigt | 343/713 |
| 4,414,690 | 11/1983 | Norholt et al. | 455/291 |
| 4,602,260 | 7/1986 | Lindenmeier et al. | 343/713 |
| 4,757,322 | 7/1988 | Yokogawa et al. | 343/712 |
| 4,791,426 | 12/1988 | Linenmeier et al. | 343/713 |

FOREIGN PATENT DOCUMENTS

| | | | |
|---|---|---|---|
| 0960759 | 1/1975 | Canada | 343/717 |
| 2406324 | 8/1975 | Fed. Rep. of Germany | 343/713 |
| 2421437 | 11/1975 | Fed. Rep. of Germany | 343/713 |
| 2429628 | 1/1976 | Fed. Rep. of Germany | 343/713 |
| 3719692 | 12/1988 | Fed. Rep. of Germany . | |
| 0050833 | 3/1983 | Japan | 455/291 |
| 0031204 | 2/1987 | Japan . | |

OTHER PUBLICATIONS

Johnson et al., Antenna Engineering Handbook, 2nd Ed., New York McGraw-Hill, 1984, Chapter 43 Impedance Matching and Broadbanding, David F. Bowman, pp. 43-1 to 43-32.

*Primary Examiner*—Michael C. Wimer
*Assistant Examiner*—Peter Toby Brown
*Attorney, Agent, or Firm*—Michael J. Striker

[57] ABSTRACT

An active window pane antenna for use in motor vehicles includes an antenna conductor arranged on the window pane and being connected via a conductor of negligible length to an input terminal of an active four terminal network also arranged on the pane. The output terminals of the network are connected via a first section of a transmission line to an antenna connector whose ground contact is connected for high frequencies to a ground point on the body of the motor vehicle. The impedance of the first section of the transmission line is not negligible for the received frequency bands and the input impedance of the four terminal network is balanced with respect to the first section. A second section of the transmission line extends from the antenna connector to a receiver.

2 Claims, 7 Drawing Sheets

PANE ANTENNA HAVING AN AMPLIFIER

BACKGROUND OF THE INVENTION

The present invention relates to an active reception antenna arranged on a non-conductive, flat supporting piece set in a conductive body of a motor vehicle. The antenna is effective up to UHF range of wavelengths.

Antennas of this kind are described for example, in DE publications P 3315458, P 3410415, P 3423205, P 3618452, P 3619704 and P 3719692. In all these prior art antennas, a window pane is employed as the non-conductive, flat supporting surface and is surrounded by a conductive frame to which the ground terminal of a four terminal network is connected by a short conductor. The input of the active four terminal network is situated in an immediate proximity to the connection point of the antenna conductor and is connected thereto by a very short conductor in order to achieve optimum properties of the active antenna. The position of the antenna conductor on or near the window pane and the position of the connection point of the antenna conductor are determined by the requisite properties of the antenna with respect to the desired excitation and polarization action. For this reason, in prior art antennas, for example the antennas listed in the above mentioned German patent publications, it has been necessary to provide, in the immediate proximity of the connection point of the antenna conductor, both an installation space for the amplifier and the possibility to connect the amplifier to a ground point of the vehicle body.

The output of the amplifier, which is situated immediately at the ground point, has formed a connector contact point of the antenna from which mostly a coaxial transmission line has led to a receiver. In practice the forms of antennas of this kind must be selected under the consideration of limiting aspects given in the motor vehicle environment, inasmuch as the required proximity to the ground point can be achieved only at limited number of locations. Therefore, many forms of antennas, which in spite of a good performance of their antenna conductor, cannot frequently be realized in practice. For example, if an optimum connection point of the antenna conductor of an antenna structure lies in the range of an edge between the roof of a motor vehicle and the front or the rear window pane, then a matching network or the amplifier must be installed in the range of the roof. In many motor vehicles, the inner side of the roof is covered by a web of fabric which precludes an access to the metal sheet and prevents the installation of the amplifier between the metal sheet and the fabric web.

Under the plastic screens or shields there is also frequently insufficient space for installing components having a minute structural height. Therefore, ground points in the range of deposition racks must have been used in spite of the fact that the antenna structures were situated in the upper region of the window pane of the motor vehicle.

Moreover, by introducing plastic structural parts in the construction of a motor vehicle, such as for example plastic frames surrounding the window of rear trap door of a station wagon, there is no longer the possibility to provide a sufficiently short connection conductor between a ground point of the vehicle body and the connection point of the antenna conductor secured on the pane.

The above described circumstances made it necessary to place an amplifier, which in the following description will be called an active four terminal network, on the vehicle body at a relatively large distance from the connection point of the antenna conductor in order to insure a short connection to the ground point. Consequently, the clearance between the connection point of the antenna conductor on the pane and the input of the four terminal network is to be bridged by a correspondingly long connection wire.

The connection wire is printed on the pane parallel to an edge of the latter or is laid along the upper surface of the vehicle body. In the case of plastic vehicle parts which surround the window pane, the connection wire can be laid also on the upper surface of a plastic part or can be embedded in the plastic part provided that losses of the plastic material or the respective frequency ranges are sufficiently low. However, plastic materials hitherto used in motor vehicles exhibit at frequencies of the ultrashort wavelength range high dielectric losses. Consequently, signals in connection wires which extend in the proximity of the upper surface of such a plastic material are subject to cause high damping and the performance of antennas installed according to the prior art frequently does not meet the requisite standard.

Therefore, the principle of designing an active antenna having a shortest possible conductor between the four terminal network and the connection point of the antenna conductor situated on the window pane, cannot be realized such as to obtain the advantage of the maximum possible signal-to-noise ratio. This disadvantage is present substantially for all frequency ranges, but is particularly serious in the case of relatively low frequencies of the long medium and shortwave ranges for which an antenna amplifier having a capacitive high impedance input is employed. In these frequency ranges the use of a long connection wire brings about the disadvantage of an additional capacitance relative to the vehicle body. The additional capacitance has the disadvantageous effect particularly in the case of electrically short antennas defining a correspondingly small antenna capacity.

SUMMARY OF THE INVENTION

It is therefore a general object of the present invention to provide an antenna of the above described type which eliminates the disadvantages of a long connection wire between the connection point of the antenna conductor on the pane and the four terminal network, even if the connection point of the antenna conductor is spaced apart from an applicable ground point on the vehicle body by a distance which is not negligible for the transmission of high frequencies.

In keeping with this object and others which will become apparent hereafter, this invention resides in the provision of an elongated antenna conductor secured on the non-conductive, flat supporting piece such as a window pane of a motor vehicle, a connector plug having a ground contact conductively coupled for high frequencies with a ground point on the vehicle body, an active four terminal network having two input terminals and two output terminals, an output transmission line having a first section for connecting the output terminals with contacts of the connector plug, and a second section for connecting the contacts of the connector plug with a receiver, a connection point at one end of the antenna conductor being connected via a short conductor having a negligible impedance, with one of the input terminals while the other input terminal is connected via a short conductor having a negligible impedance, with one of the output terminals, the first section of the output transmission line having one conductor connected between the ground contact of the connector plug and the one output terminal, and the first section due to its length having a non-negligible impedance for high frequencies.

The arrangement of the antenna of this invention makes the first section of the output transmission line, between the output terminals of the four terminal network and the connector plug coupled to the ground point on the vehicle body, a component part of the effective antenna.

In the preferred embodiment, the output transmission line is in the form of a thin coaxial cable. However, in special applications, the output transmission line can be also in the form of a twin wire whose partial sections can be printed on the pane.

As mentioned before, the advantage of the antenna according to the invention is to be seen in the elimination of the long connecting wire between the connection point of the antenna conductor and the input of the four terminal network because the input can be placed in an immediate proximity to the connection point.

For example, in the antenna of this invention the amplifier or the active four terminal network can be placed on the non-conductive flat supporting piece, such as a window pane. As a result, the manufacture of motor vehicles has available a complete "antenna pane" to which only an output transmission line section is to be added. Therefore, further component parts which hitherto must have been applied to additional installation points, can be dispensed with.

The first section of the output transmission line in the antenna of this invention participates in the determination of quality of the antenna and therefore must be taken into account during the optimization of the antenna performance.

The novel features which are considered as characteristic for the invention are set forth in the appended claims. The invention itself, both as to its construction and its method of operation, will be best understood from the following description of specific embodiments when read in connection with the accompanying drawings.

DESCRIPTION OF THE PREFERRED EMBODIMENTS

Figure 1:
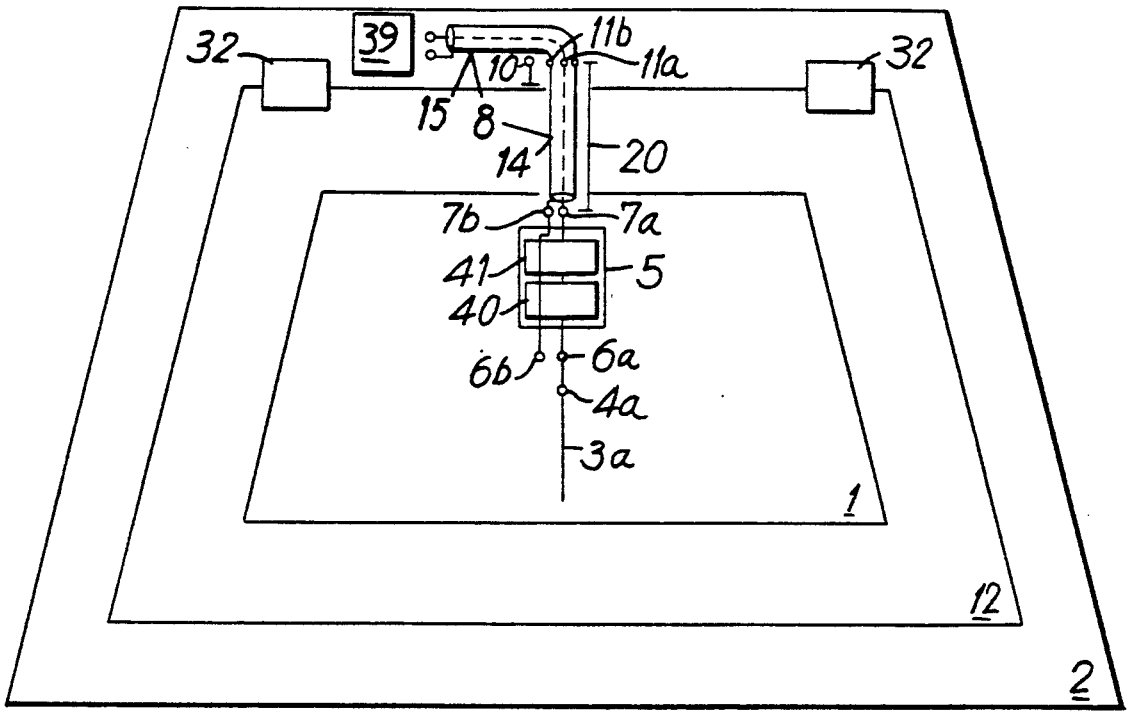
FIG. 1 shows an elevation view of an active pane antenna of this invention installed in a vehicle body.

FIGS. 1 to 5 show, by way of example, different modifications of the antenna of this invention situated in a motor vehicle. In all examples, the distance (indicated by arrow 20) between the output terminals 7*a*, 7*b* of the four terminal network or amplifier 5 and the location of contacts 11*a* and 11*b* of an antenna connector plug and a ground point 10 on a vehicle body 2, determines the length of a first section 14 of an output transmission line 8. The impedance of the first section 14 is not negligible at high frequencies.

Figure 2:
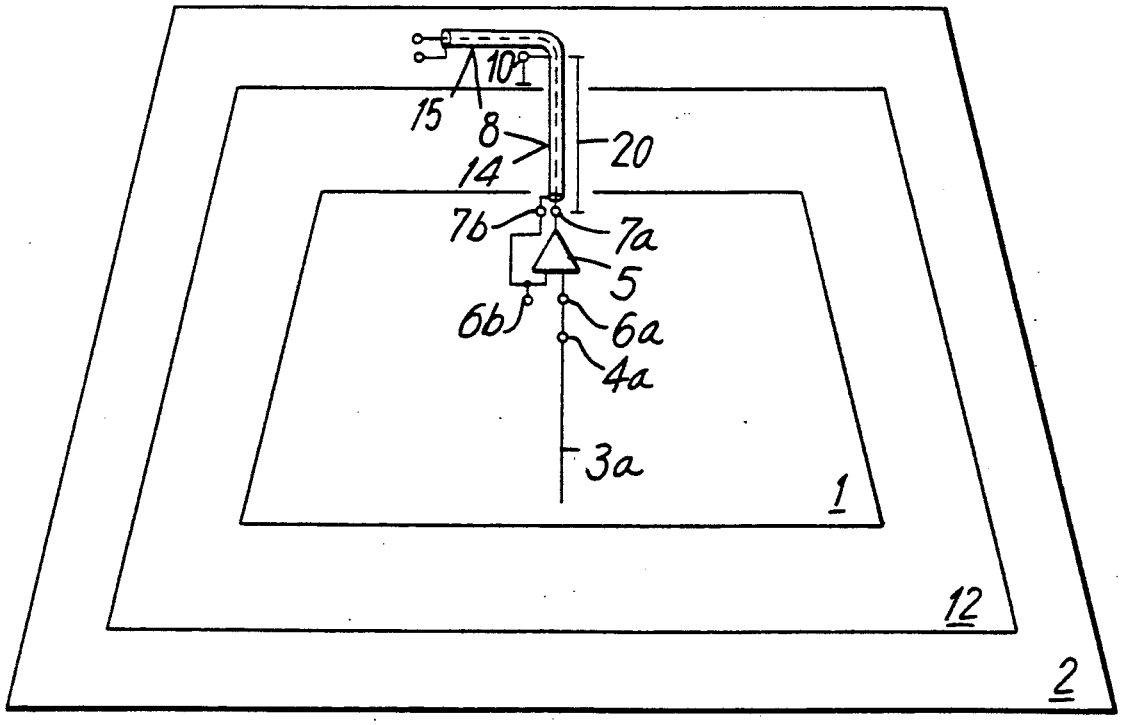
FIG. 2 shows a modification of the antenna of FIG. 1.

In FIGS. 1 and 2, the distance 20 is determined by the width of a frame 12 of plastic surrounding the pane 1. The pane 1 is embedded in the frame 12, as in the construction for example of trunk lids or rear trap doors of a modern station wagon. The rear trap door in such a motor vehicle is attached to the body of the vehicle by means of hinges 32.

In FIG. 1, the active antenna of this invention includes an antenna conductor 3*a* and a four terminal network 5 mounted on a pane 1 surrounded by a broad frame 12 of plastic. The four terminal network 5 includes low loss transformation elements 40 whose output is connected to the active part or amplifier 41 of the network. The output of the amplifier is connected via a first section 14 of the coaxial transmission line 8 to an antenna connector plug 11*a* and 11*b* mounted at a ground point 10 on the conductive body 2 opposite an edge of the frame 12. The output terminal 7*b* which is connected to the grounded outer conductor of the transmission line 8, is further connected, via a short conductor 9 having a negligible impedance, with the input terminal 6*b* of the network 5. The other input terminal 6*a* is connected to the antenna conductor 3*a*. The transformation elements 40 and the active part or amplifier 41 of the network 5, in combination with the selected configuration of the antenna conductor 3*a* and the first section 14 of the output transmission line 8, determine the impedance matching conditions at the input terminals 6*a* and 6*b* of the active four terminal network which can be adjusted such as to provide, at the output terminals 7*a* and 7*b* of the network 5, good signal to noise quality for the respective frequency ranges for which the antenna is designed. Efforts have been made to achieve, as simply as possible by a suitable configuration of the antenna conductor 3*a* and a positioning of the first section 14 of the output transmission line 8, the desired matching conditions of transforming circuits including the transformation elements 40 in the four terminal network 5.

In certain cases the impedance matching arrangement, leading to a good signal-to-noise ratio at the output of the active four terminal network 5 can be achieved also without the use of the transforming low loss reactive elements 40, by a suitable selection of the construction of the antenna conductor 3*a* and the first section 14 of the output transmission line 8. In this manner, the embodiment illustrated in FIG. 2 provides, due to its simplicity, a particularly advantageous construction of the antenna of this invention wherein the antenna conductor and the four terminal network, as in the embodiment of FIG. 1, are situated on the pane 1 surrounded by a plastic frame 12. The output transmission line 8 is in the form of a coaxial cable.

Figure 3:
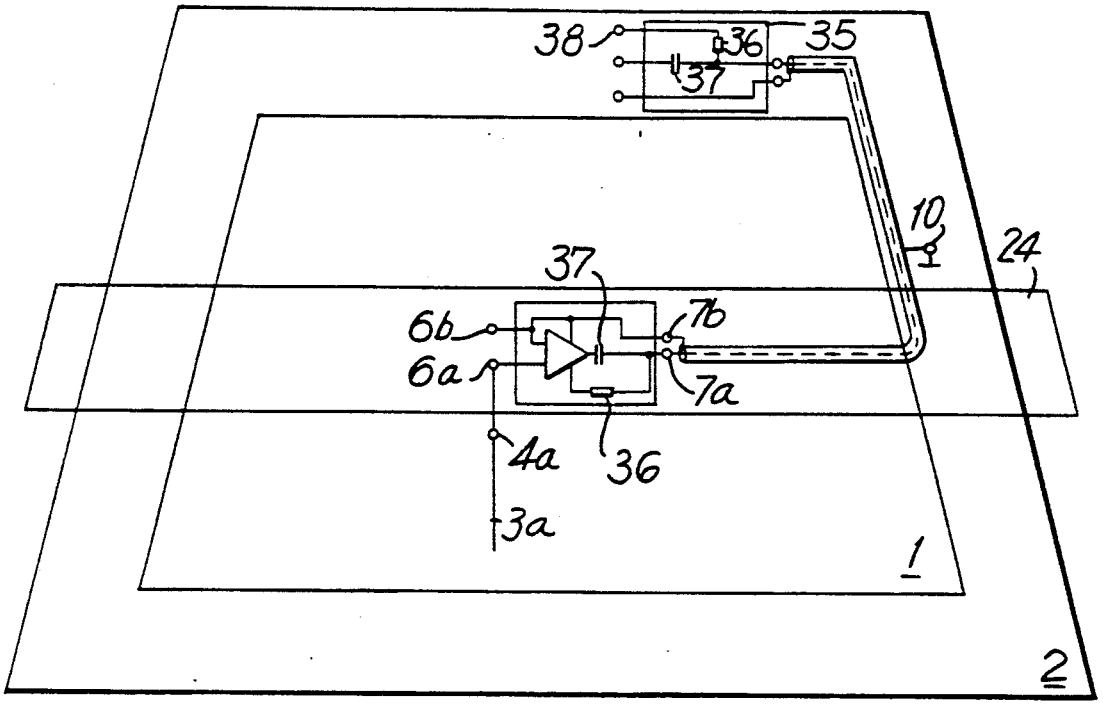
FIG. 3 shows another embodiment of the antenna wherein a supply voltage to the active four terminal network or amplifier is applied via the output transmission line.

FIG. 3 shows an active antenna wherein the amplifier 41 of the network 5 is not located in the proximity of an edge of the rectangular pane 1 but is located at a relatively large distance from this edge. In spite of the fact that an amplifier located in the central region of the window pane might impair the visibility through the window, the dimensions of the contemporary miniature amplifiers impair the visibility at least from the position of the driver via the rear mirror only insignificantly.

It is of particular advantage, as shown in FIG. 3, when in this embodiment, the amplifier of the network 5 is mounted on the pane of the window of the rear trap door in the range of the rear spoiler plate 24, because in this case the visibility is not impaired. It is also advantageous when the first section 14 of the output transmission line 8 is guided in the range of the spoiler plate 24. A similar favorable installation situation results in the case of a wiper motor mounted on the pane. The power supply voltage for the amplifier can be fed from a power source terminal 38 and a network 35 via the coaxial cable 8.

Figure 4:
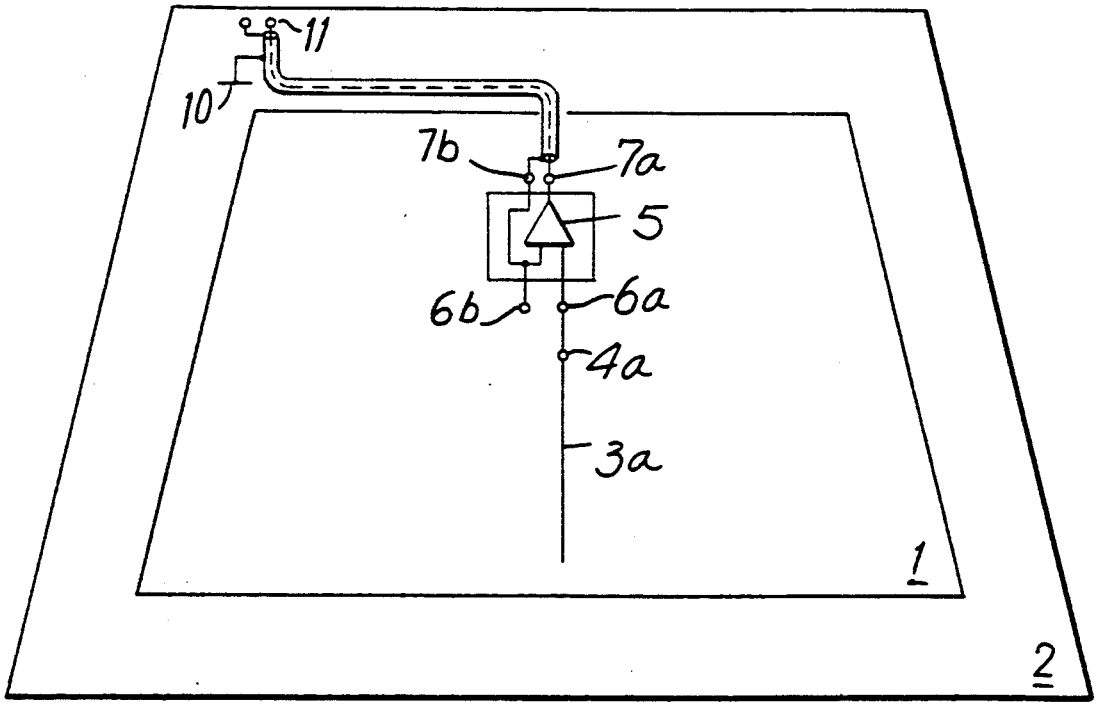
FIGS. 4 through 14 show further embodiments of the antenna of this invention.

Another situation for an advantageous application of the antenna of this invention is shown in FIG. 4. In this embodiment, the amplifier is situated near the upper edge of the window pane. However, the connector plug 11*a* and 11*b* at the output of the antenna in this example cannot be, for reasons of a specific design of the motor vehicle, located at a ground point on the vehicle body which is situated in close proximity to the amplifier. For example, there is no screen available which would permit the access to the ground point 10. In such cases, the output transmission line 8 is preferably exactly parallel to the upper edge of the pane 1 and is connected to the connector plug 11*a* and 11*b* at an easily accessible ground point 10.

The length 20 of the first section 14 of the transmission line 8 is again non-negligible for impedance matching at high frequencies, which means that in the antenna of this invention the active four terminal network 5 is not grounded at the ground point 10 via a conventional connection having a negligible impedance at high frequencies.

The connection to ground in prior art antennas is made preferably with a low impedance, that means with a low inductance. In the construction of motor vehicles, flat metal parts screwed to the body of a motor vehicle are used to fix mechanically various components. Such parts provide almost ideal ground connections. If such flat metallic reinforcing parts are not applicable, then for the ground connections are employed short conductors in the form of a conductive mesh, the so-called ground bands. The purpose of this measure is to minimize to a negligible level voltages resulting due to currents flowing on the surface of the vehicle body.

In prior art antennas, the antenna impedance connected to the amplifier is therefore formed exclusively by the combined impedance of the antenna conductor and the part of the vehicle body surrounding the window pane with a relation to ground which is defined by the ground connection of the amplifier.

If the impedance of this ground connection is not negligibly low, as is the case of the antenna of this invention, then the change in impedance of the passive part of the antenna is not neglible too. For high frequencies, the impedance of the ground connection is connected in series with the impedance of the antenna conductor in the case of an ideal ground point, and accordingly the overall impedance of the antenna is changed.

In the prior art antennas, the tolerable impedance of the mass or ground connection depends on the impedance of the antenna conductor (in the case of an ideal low resistance grounding point). With a lower resistance of the antenna conductor, a corresponding lower impedance of the ground connection is required.

Pane antennas are frequently designed for broader frequency bands. This holds true almost without exception for active reception antennas which are supposed to cover a broad frequency spectrum such as, for example, the ultrashort wavelength range, the long, medium and short wavelength range or the television VHF and UHF ranges. Even antenna structures such as, for example, lambda/2 long antenna conductors with this high impedance at higher frequency ranges. Therefore, in designing a prior art broad band antenna, the lowest impedance values occurring in the frequency band have been used for determining the tolerable impedance of the ground connection.

The effect of the mass or ground connection will be explained in the following example. Assuming a ground connection by means of a conventional grounding band having a cross-section 6 times 1 mm and made of a conductor netting or mesh, then the resulting inductance of such a grounding band is about 8 nH/cm. With reference to a passive antenna and an output transmission line having a conventional characteristic impedance of 50 Ohms and assuming that the antenna conductors are designed such as to produce an impedance of 50 Ohms with a standing wave ratio of 2, then a minimum real impedance value of 25 Ohms will result.

If in the antenna structure according to the above example, a series connected impedance of j25 Ohms of the grounding band is tolerated and the resulting impedance has a phase shift of 45°, then the corresponding permissible length of the ground band is about lambda/60. For an ultrashort wavelength band with a center wavelength of 3 m for example the maximum permissible length of the ground band is about 5 cm.

In the embodiments of the antenna of this invention illustrated in the Figures, the connection point 4*a* for the antenna conductor 3*a* is always immediately connected to the input terminal 6*a* of the active four terminal network 5. The output terminals 7*a* and 7*b* of the amplifier are immediately connected to the output transmission line 8. Therefore, to distinguish between the connection point 4*a* of the antenna conductor and the input terminal 6*a* of the four terminal network is needed in exceptional cases only. In practice, the two connection points 4*a* and 6*a* are mostly identical. An "immediate" connection, however, is present even in the case of non-identical connection points as long as the high frequency properties of the antenna such as impedance matching relationships, for example the capacitive load of the antenna conductor 3*a* at the connection point 4*a*, are not changed unduly by the connection.

The output transmission line 8 in the antenna of the invention consists of two sections. The first section 14 is delimited by the length 20 of the transmission line between the output terminals 7*a* and 7*b* of the four terminal network and the connection of contact 11*b* of the antenna connector plug with the grounding point 10 on the conductive vehicle body 2. The first transmission line section 14 is a component part of the passive antenna portion and, as a rule, conducts symmetric or in phase currents which, at the ground point 10, flow into the car body. The ground point 10 represents, for high frequencies, a low impedance connection point to the vehicle body 2. The location of the grounding point 2 is selected individually with respect to specific conditions of a particular motor vehicle.

If it is possible to select among different ground points then, as a rule, the output of the active four terminal network is connected to the nearest available ground point. This preference results from the fact that the first section 14 of the transmission line 8 is a component part of the antenna and therefore must be laid in a definite way. A well defined layout of the first section 14 is easier to accomplish with that having a shorter length. The specific aspects of a simpler installation of the output transmission line 8 in its first section 14 with respect to specific conditions of a particular motor vehicle or in view of the operability of the antenna can be also employed for the selection of a more remote grounding point 10.

The second section 15 of the output transmission line 8 is immediately connected by the antenna connector plug 11*a* and 11*b* with the first section 14 and, as a rule, employs the same type and cross-section of the transmission cable. In principle, this invention permits to use different types of transmission cable in the first and second sections, for example, the first section 14 can be made as a twin wire cable and the second section 15 as a thin coaxial cable. Care should be taken, however, that both types of transmission lines have approximately the same characteristic impedance. The second section 15 of the line 8 leads in conventional manner from the antenna conductor plug 11*a* and 11*b* to the receiver 39. In the case of antennas of this invention, the impedance essential for signal feeding or matching the active four terminal network 5, is the input impedance between the terminals 6*a* and 6*b*. This input impedance can be measured in conventional manner by impedance meters using the output transmission line 8 whereby the terminals 6*a* and 7*a* of the network 5 are short circuited and the measured value is taken at the input terminals 6*a* and 6*b*.

Both the input impedance of the amplifier or four terminal network 5 and the excitation signal and the balanceable power depend both on the geometry and position of the antenna conductor 3*a* as well as on the layout of the first section 14 of the output transmission line 8, on the length 20 of the first section 14 and on the position of the antenna connector plug 11*a* and 11*b* and ground point 10 of the vehicle body 2.

Examples of typical running of the output transmission line 8 and its first section 14 are illustrated in the drawings. In FIGS. 1 and 2 the output terminals 7*a*, 7*b* of the network 5 are situated in proximity to an edge of the window pane 1. The pane itself is embedded in a plastic frame 12 and the output transmission line 8 is laid in a shortest possible way over the plastic frame substantially along the vertical line of symmetry of the pane 1 up to a marginal portion of the conductive vehicle body 2 surrounding the frame 12 where the conductive outer sheathing of the transmission line or cable 8 is galvanically connected at the grounding point 10 to the conductive body. At this point is located also the antenna connector plug 11*a* and 11*b*. In the embodiment of the active antenna according to this invention illustrated in FIG. 3, the active four terminal network 5, as mentioned before, is mounted in the range of a rear spoiler plate 24. This enables an advantageous running of the output transmission cable 8 in the region of the pane 1 which is covered by the spoiler plate so that the transmission line does not impair the view through the window. Spoiler plates made of plastic or rubber like materials frequently induce high losses at higher frequencies. Current flowing on the outer sheath of the output coaxial cable 8 is strongly affected by this dissipative material. The stronger is the current the higher are the losses.

In the antenna according to this invention, this current is made smaller and accordingly the losses are kept at a low level by using an active four terminal network 5 having a high input impedance.

Figure 5:
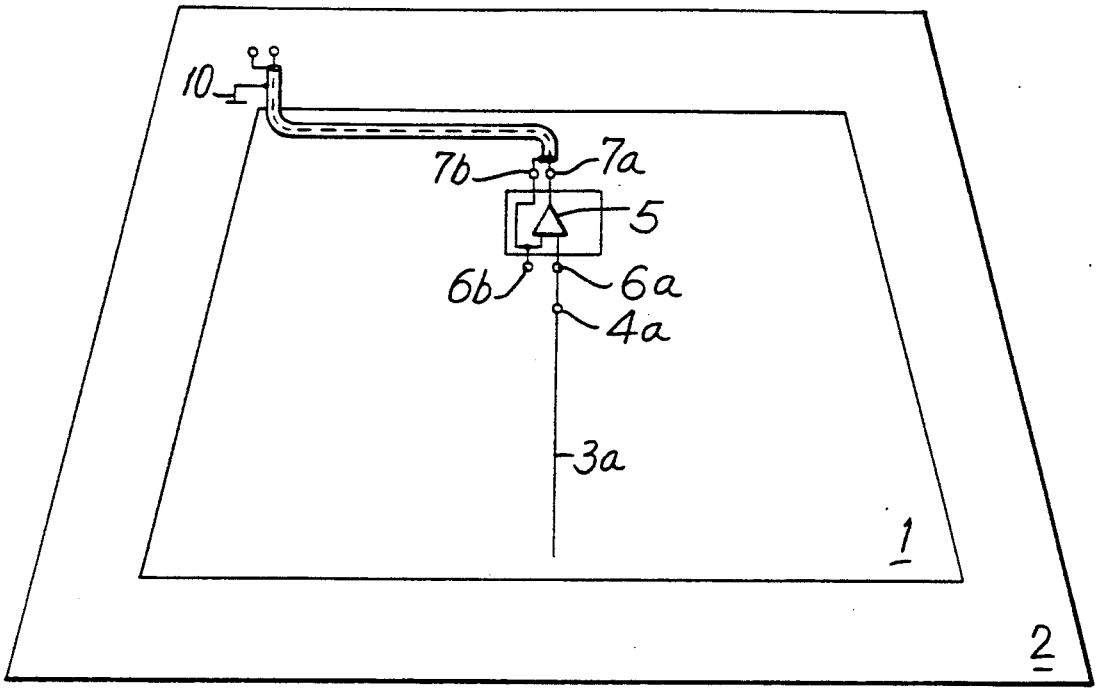

FIGS. 4 and 5 show embodiments of the antenna of this invention wherein the active four terminal network is situated in proximity to the center of the upper edge of the pane 1 and is secured to the latter by gluing or soldering. In FIG. 4, the first section 14 of the output transmission line or coaxial cable 8 is bent such that its intermediate portion is guided on the conductive vehicle body 2 along the upper edge of the pane, for example under a screen or shade, and terminates at the antenna connector plug 11*a* and 11*b* located at the ground point 10. Such an arrangement has the advantage that the first section 14 of the output transmission line, even if extended in length, is not visible.

In FIG. 5, the intermediate part of the first section 14 is guided on the pane 1 along its border line with the vehicle body and in the corner area of the pane, the conductive outer sheath of the coaxial cable is connected at the grounding point 10 to the vehicle body. The connector plug contact 11*b* terminating the first line section 14 is again situated in the proximity to the ground point 10.

Figure 6:
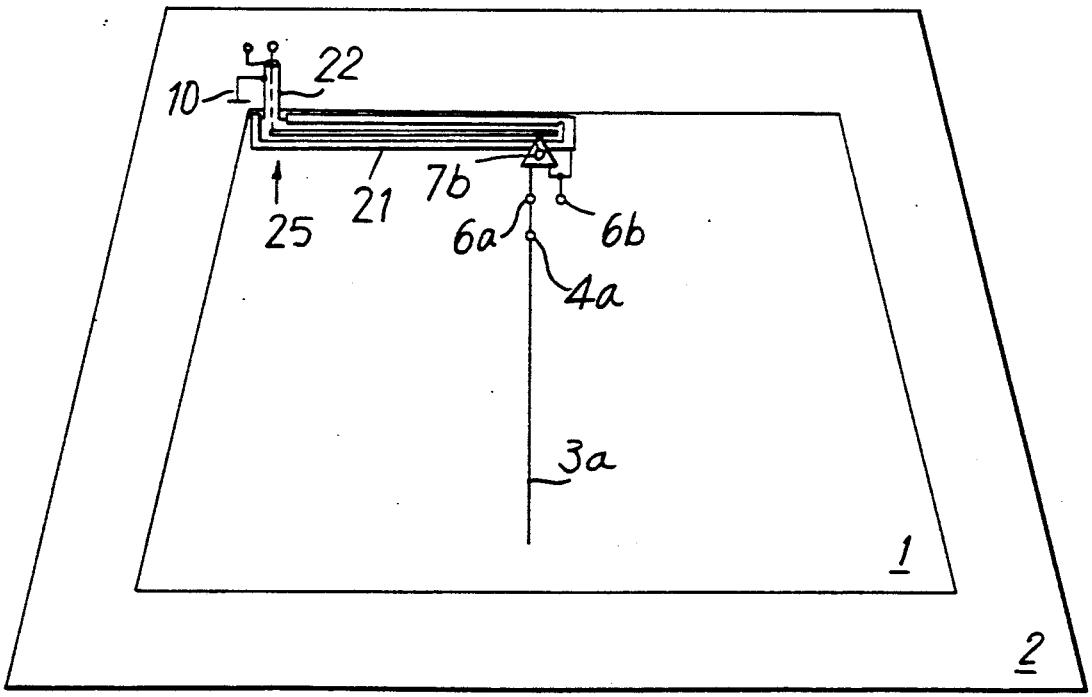

FIG. 6 shows an advantageous modification of the antenna of FIG. 5 wherein the first section 14 of the output transmission line or coaxial cable is assembled of two parts 21 and 22 of which the part 21 is printed on the pane as a flat pseudo-coaxial cable which, at the junction point 25, is connected to a piece of standard coaxial cable forming the second part 22. By a suitable selection of the width of the printed flat conductors of the first part 21, it is possible to achieve a similar characteristic impedance of the pseudocoaxial cable as that of the standard coaxial cable. The flat conductors of the first part 21 can be printed on the pane by a screen printing process and heated in a heating field simultaneously with other printed circuit components of the antenna. In this manner, the technological expenditures for the completion of the first section 14 of the output transmission line 8, particularly for the connection of the piece of the standard coaxial cable 22, are substantially reduced.

Figure 7:
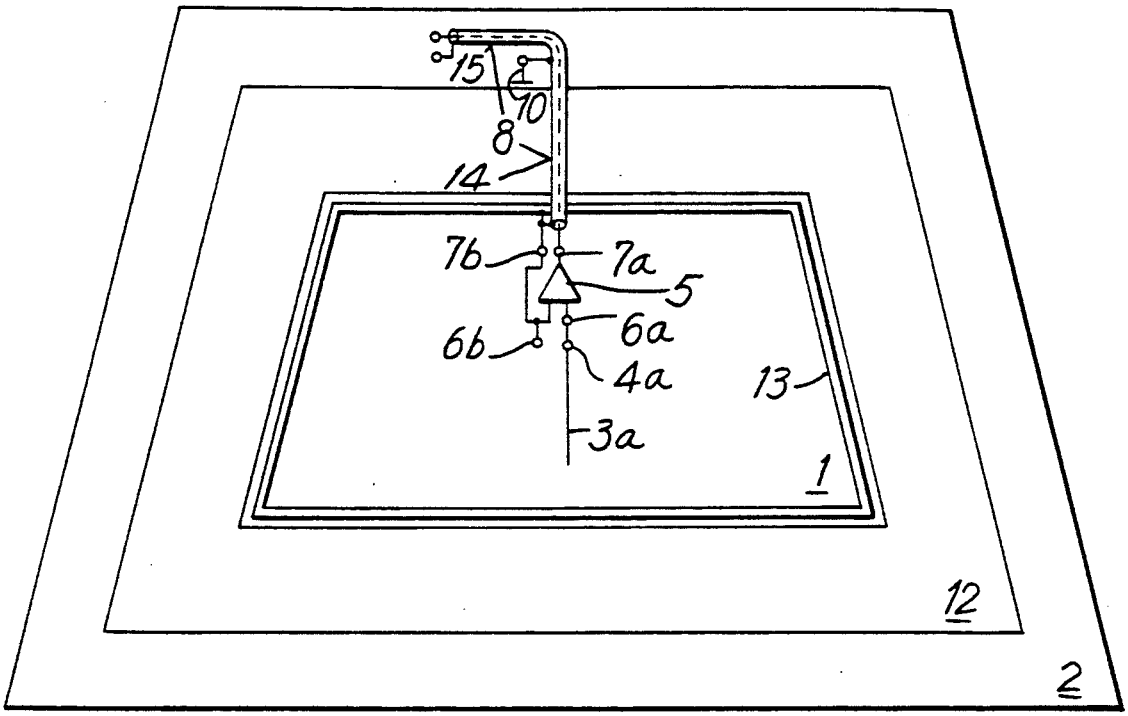

FIG. 7 shows the embodiment of the antenna of the invention secured on a window pane 1 which is attached to the vehicle body 2 by means of a plastic frame 12. In this embodiment, the pane 1 is provided with a conductive peripheral strip 13 applied on the pane along its edges. The conductive strip in the example of FIG. 7 is connected to the grounded input terminal 6*b* of the active four terminal network 5. This arrangement of the strip in the antenna of this invention has the advantage when, for example, the losses of the plastic frame 12 which surrounds the pane 1 would cause, in the absence of the conductive strip 13, considerable power output losses of the antenna. The conductive strip 13 which separates the antenna system from the frame 12 acts as an electrical counterbalance which concentrates the field lines of the electromagnetic field impinging on its surface. Consequently, the field intensity in the range of the plastic frame is reduced and the overall losses of the electromagnetic field are reduced accordingly with the advantage of an improved efficiency of the antenna of this invention.

Another advantage is to be seen in the possibility to change, by means of the peripheral conductive strip 13, the natural resonant frequency of the opening in the vehicle body around the non-conductive surfaces of the pane 1 and frame 12 because, for higher frequencies, the effective opening in the car body becomes smaller. In this manner, the resonance frequency can be tuned to a resonant frequency required for the reception of a frequency band and, at a higher frequency, can be even shifted into this desired band.

Figure 8:
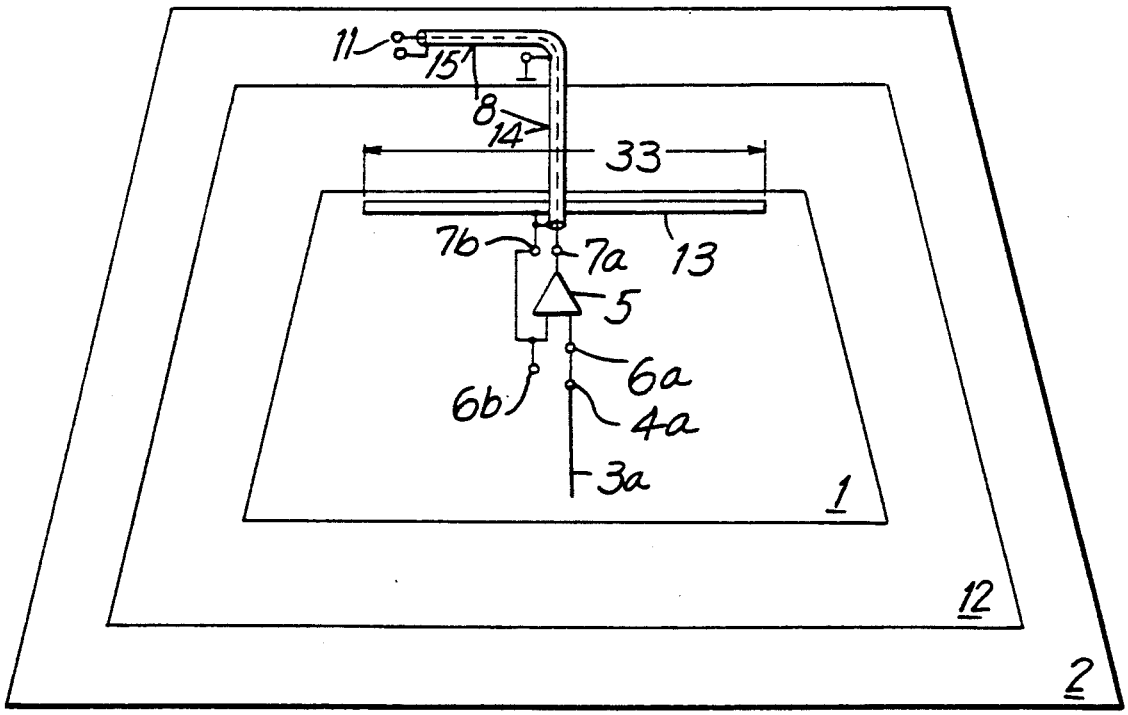

In the embodiment of FIG. 8, the conductive strip 13 does not form a peripheral frame; instead, only a section of the strip 13 extends substantially parallel to the upper edge of the pane 1 at the center of which is also located the active four terminal network 5. This arrangement also concentrates field lines impinging on the surface of the conductive strip section 13, but the strip section affects the resonant frequency of the opening in the car body only insignificantly in comparison with the arrangement of FIG. 7. The strip section 13 connected symmetrically to the conductive sheath of the output coaxial cable 8 acts also as a counterbalance for the antenna conductor 3*a*. It provides a decoupling of the dissipative plastic material of frame 12 surrounding the pane 1 and enables, by a suitable selection of the length 33 of the conductive strip section 13, favorable adjustment of the input impedance of the amplifier 5.

Figure 9:
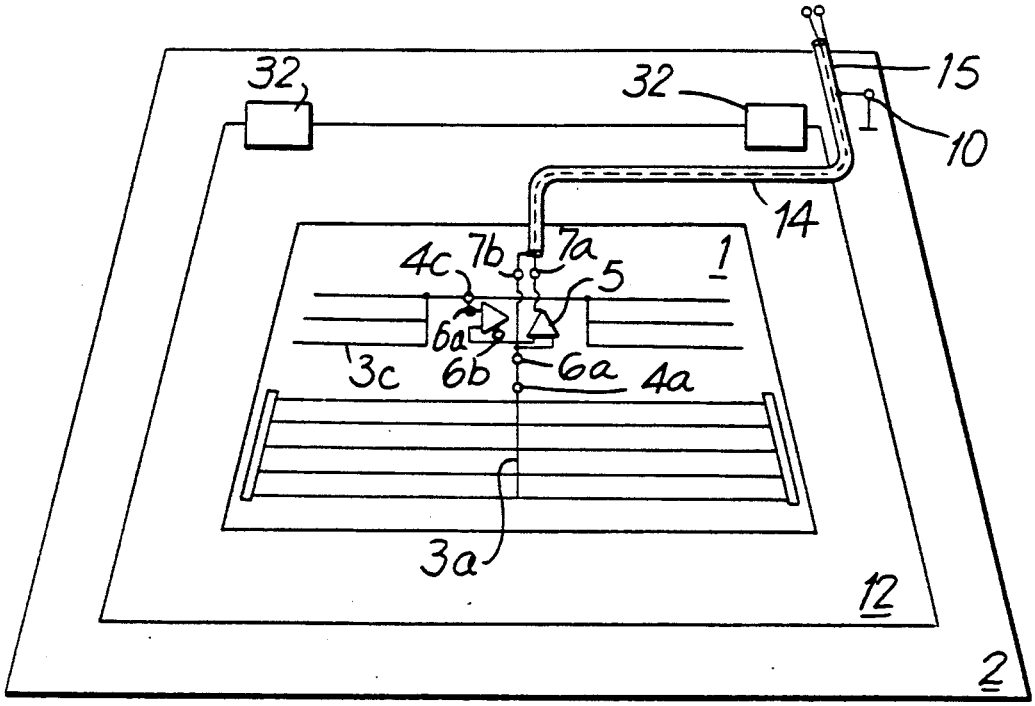

As a rule, antennas for the broadcast reception must cover the long, medium and short wavelength ranges as well as the ultrashort wavelength ranges. FIG. 9 shows an antenna of this kind constructed in accordance with this invention. It will be seen that an active four terminal network 5 is provided for each of the two wavelength ranges. If the antenna conductor 3*a* is sufficient for receiving signals in the ultrashort wavelength range, the branch of the active antenna for the ultrashort wavelengths can be replaced by a passive branch.

In this example, the antenna conductor 3*c* is optimized in a known manner described for example in the DE patent application P 3410415 for the reception of the long, medium and short wavelengths of the broadcasting range. The antenna conductor 3*c* is also assigned to the ultrashort wavelength range and consists of an upright conductor extending along the vertical line of symmetry of the pane 1 and of heating conductors 50 of the pane heating system which is electrically connected to the antenna conductor 3*a*. The output terminals of the two four terminal networks 5 are interconnected by means of conventional separating filters or networks and connected via common output terminals 7*a* and 7*b* to the output transmission line 8. The crossing of the antenna conductor 3*b* with-conductors leading to the output terminals 7*a* and 7*b* is made with advantage in such a manner that the conductors leading to the output terminals are provided on a side plate of the four terminal network 5.

Figure 10:
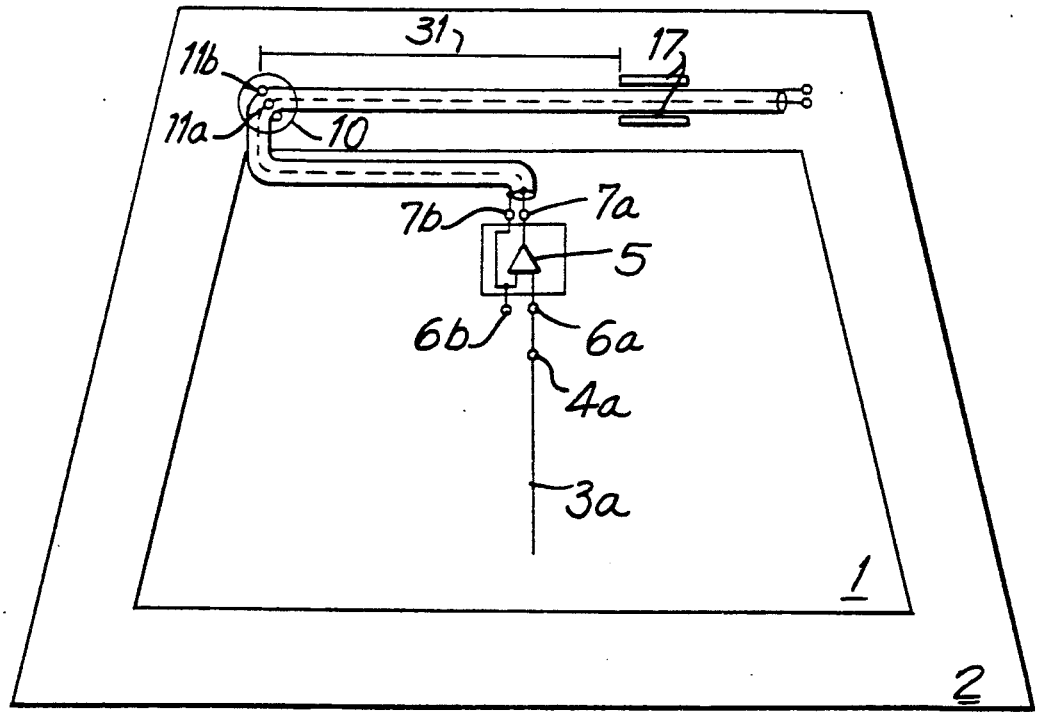

In FIGS. 1 through 9 and 11 through 14, the connection of the outer sheath or conductor of the output coaxial cable 8 is connected to the grounding point 10 by means of a short galvanic connection, for example by a screw connection to the metallic car body. FIG. 10 illustrates an embodiment of the antenna of this invention which is in principle similar to the embodiment of FIG. 5. In the arrangement of FIG. 10, the low impedance connection of a high frequency signal to the grounding point 10 is achieved by a ferrite sleeve 17 inserted on the second section 15 of output transmission line 8 to provide a high impedance, broad band damping of in-phase currents on the output transmission line. In the example of the output transmission line in the form of a coaxial cable, there results in the range of the ferrite sleeve 17 a no-load condition for the conductor arrangement 26 which consists of the outer sheath of the coaxial cable 8 in combination with the conductive environment of the car body 2. The same effect takes place in the case of a twin wire transmission line.

This no-load condition is transformed in conventional manner according to the characteristic impedance of the thus formed conductor arrangement 26. For a length 34 of the conductor arrangement corresponding approximately to a quarter of the effective wavelength between the ground point 10 and the ferrite sleeve, there results for a single high frequency a short circuit to the ground point 10. For the neighboring frequencies, there results a low impedance connection.

For a selected frequency band, the impedance resulting at the grounding point 10 is to be reduced in proportion to the increase of damping caused by the ferrite sleeve, and to the decrease of the characteristic impedance of the conductor arrangement 26. The high impedance of the damping arrangement is obtained by a suitable selection of the ferrite material in the sleeve 17. The characteristic impedance of the conductor arrangement 26 is preferably made as low as possible, for example by guiding the length 34 of the second section 15 of the transmission line 8 at a minute distance from the conductive surface of the car body 2.

Figure 11:
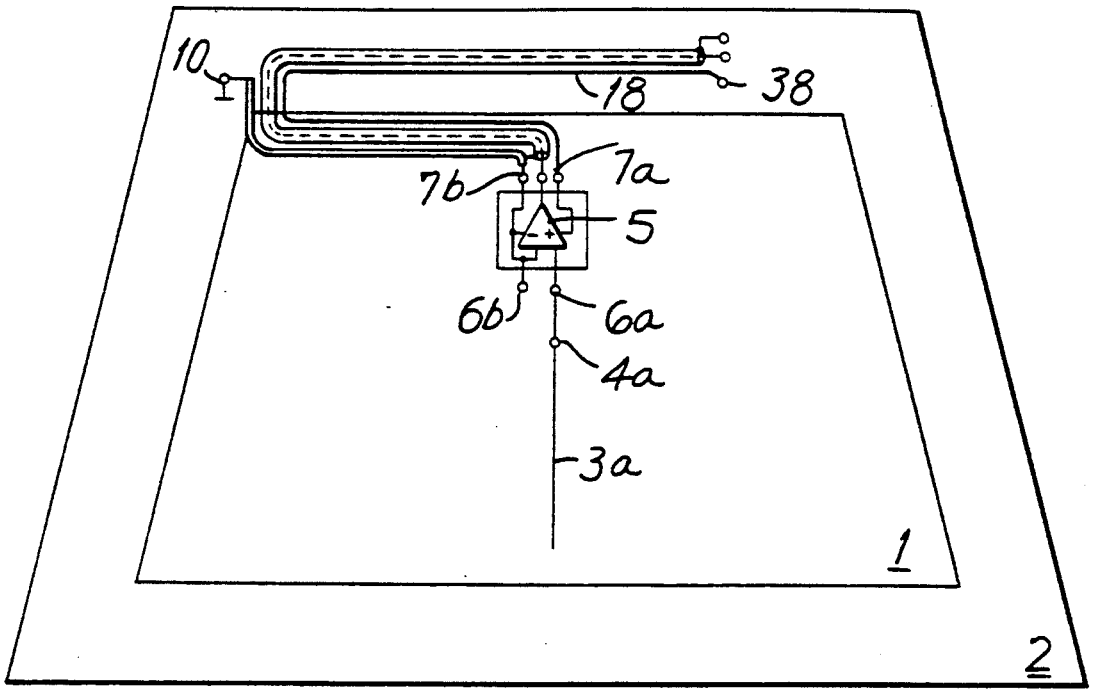

In the examples of the antennas of this invention illustrated in FIGS. 1 through 9 and 12 through 14, the outer sheath of the coaxial cable 8 is galvanically connected with the grounding point 10 at the location of the antenna connector plug 11*a*, 11*b*. For this purpose, it is necessary to strip off the insulation of the cable at this connection point. Preferably, this removal of the insulation layer can be avoided in the embodiment of the antenna as shown in FIG. 11. In the first section 14 of the output transmission line 8, a further conductor 28, preferably a grounding band of a suitable cross-section is guided parallel to the contour of the first section 14.

This parallel conductor 28 is connected at one end with the output terminal 7*b* of the four terminal network and at its other end is connected via a low impedance coupling for high frequencies with the grounding point 10. The conductor arrangement consisting of the output transmission line 8 and the conductor 28 is preferably enclosed in an additional insulation. In this manner, a well-defined low impedance capacity coupling between the conductor 28 and the outer sheath of the coaxial cable 8 is achieved, which has the same electrical quality as the corresponding arrangement in the example of FIG. 5.

Figure 12:
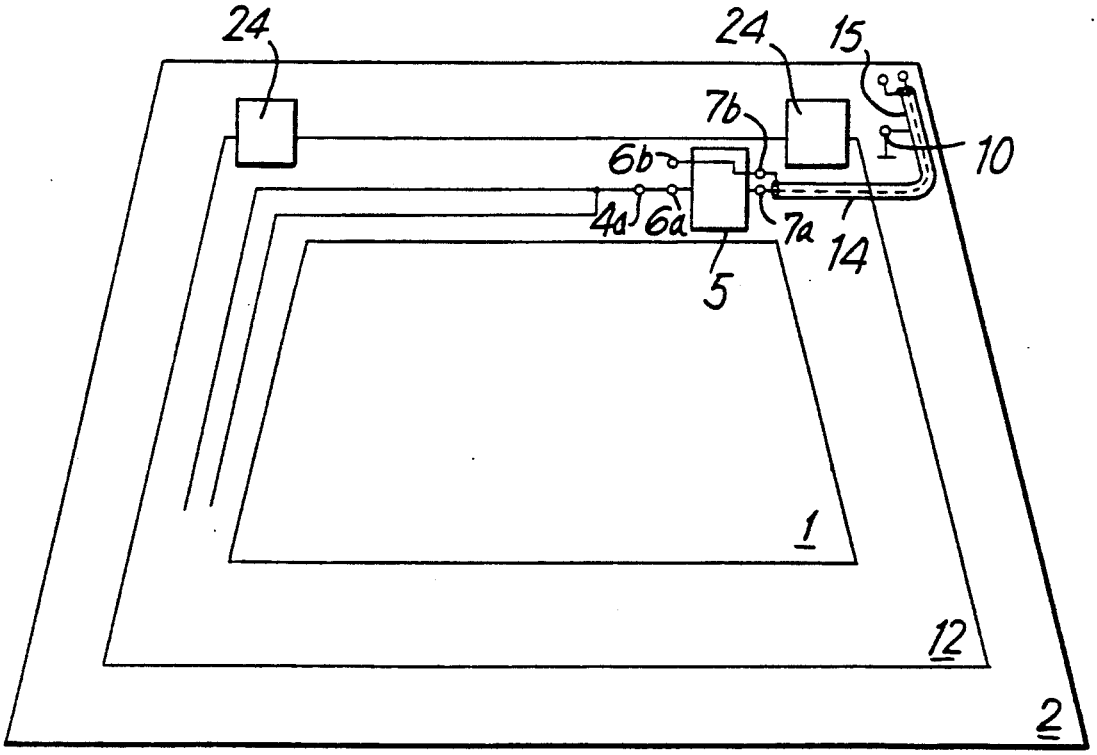

FIG. 12 shows an embodiment of the antenna of this invention wherein the active four terminal network and the antenna conductor 3*a* are arranged on the plastic frame 12 surrounding the window pane 1. A satisfactory operation of the antenna can be achieved when the plastic material of the frame 12 possesses low losses. As a rule, the losses are mostly negligible at low frequency bands, for example, in the range of long, medium and short wavelengths so that this embodiment of the active antenna has a good reception quality. With increasing frequency however the losses of the plastic frame increase and interfere with a satisfactory operation of the antenna.

In the active antenna of this invention, the amplifier of the four terminal network 5 requires a power supply from a direct current voltage source. The example of the feeding of the supply voltage from a power source terminal 38 is indicated in FIG. 11 by a conductor 18 guided along the contour of the output transmission line. The power supply circuit is closed via the outer sheath of the coaxial cable 8.

In a modification of the power supply feeding shown in FIG. 3, it is possible to utilize both conductors of the output transmission line 8, that means in the case of a coaxial cable, both the outer sheath and the inner conductor. Separation of the direct current from the high frequency signals is accomplished by means of a conventional separating network 35 using chokes 36 and capacitors 37. The advantage of this modification is that no additional power supply conductor is necessary.

Figure 13:
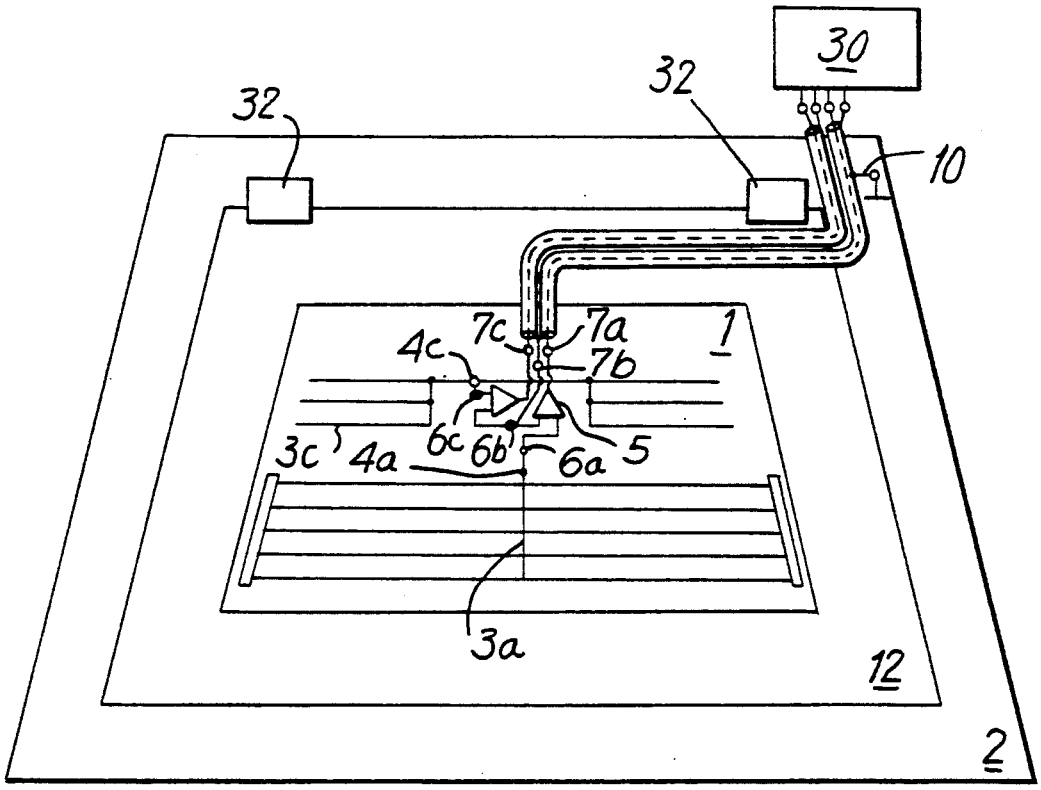

FIG. 13 illustrates an arrangement having two antennas of this invention for the same frequency range, as required for example in diversity antenna systems. In this example, each of the two antennas has a different antenna conductor 3*a* and 3*c* for feeding input signals to assigned input terminals 6*a* and 6*c* of the respective active four terminal networks. The output terminals 7*a* and 7*c* of the active four terminal networks supply in the example of FIG. 13 an assigned inner conductor of the two output transmission lines 8; the outer conductors of the two transmission lines are connected one to the other and to the common output terminal 7*b* of the two amplifiers which in turn is connected to the common input terminal 6*b* of the active four terminal networks 5.

To achieve a good decoupling of the antenna signals one from the other, the two antenna conductor structures must be suitably designed. In order to avoid, in the case of scanning diversity systems, reactive effects of load changes in the output transmission lines 8 during their switchover in the diversity switching unit, both diversity antennas are preferably equipped with amplifiers having only a negligible inner feedback.

Figure 14:
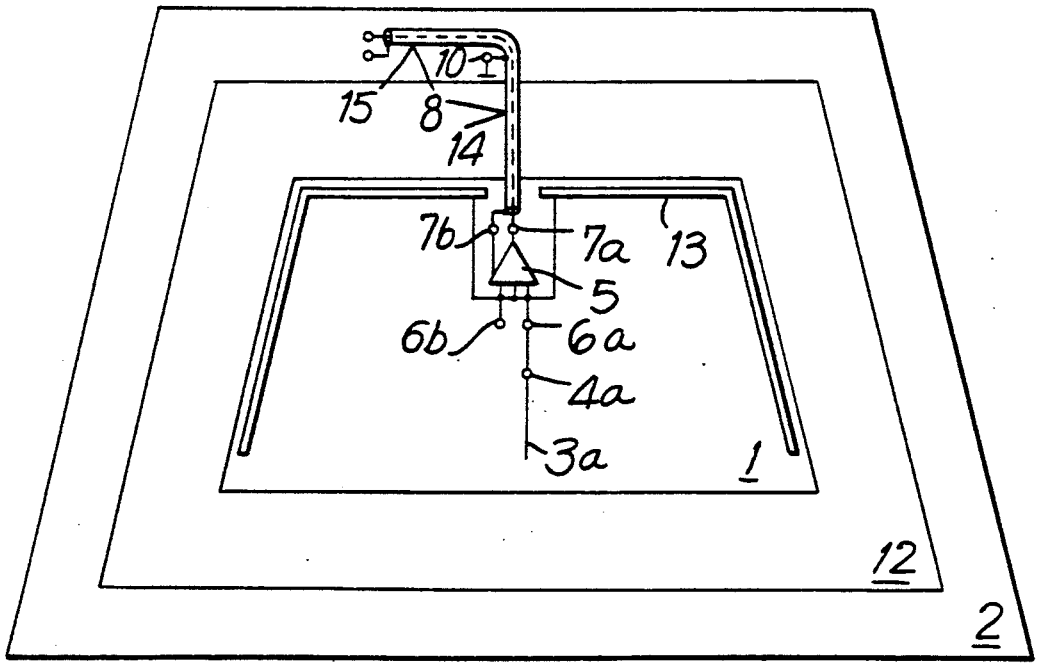

FIG. 14 shows an embodiment of an active antenna of this invention using an amplifier with a high damping for in-phase signals. In this embodiment, the second input terminal 6*b* of the antenna amplifier 5 is disconnected from the grounded output terminal 7*b*, but instead is connected to the conductive strip 13 constructed as a counterbalance.

What is claimed as new and desired to be protected by Letters Patent is set forth in the appended claims:

1. An active reception antenna arranged on a nonconductive flat supporting piece (1, 12) set in a conductive body (2) of a motor vehicle, comprising an elongated antenna conductor (3*a*) secured on the supporting piece;

an active four terminal network (5) having two input terminals (6*a*, 6*b*) facing an end of said antenna conductor, and two output terminals (7*a*, 7*b*), one (6*a*) of said input terminals being connected with a connection point (4*a*) at the end of said antenna conductor while the other input terminal (6*b*) is connected by a short conductor (9) with one (7*b*) of said output terminals;

a ground point (10) provided on the conductive vehicle body opposite an edge of said supporting piece;

an output transmission line (8) having a first section (14) extending over a portion of said supporting piece (1, 12) between said output terminals (7*a*, 7*b*) and said ground point and a second section (15) extending over the vehicle body between said ground point and a receiver;

connector means (11*a*, 11*b*) mounted on the vehicle body at said ground point to connect said first section with said second section, a contact (11*b*) of said connector means being directly connected with the ground point; and said first section (14) of the transmission line having at high frequencies an impedance which affects via said four terminal network the impedance matching between said antenna conductor (3*a*) and said input terminals (6*a*, 6*b*), said active four terminal network including a difference amplifier connected for suppressing in-phase signals, and two L-shaped conductive strips symmetrically arranged in corner areas of said supporting piece and being connected to said input terminals of said active four terminal network; one of said output terminals being connected to said contact and to said ground point via the first section (14) of the transmission line.

2. An active reception antenna arranged on a nonconductive flat supporting piece (1, 12) set in a conductive body (2) of a motor vehicle, comprising an active four terminal network (5) having two input terminals (6*a*, 6*b*) and two output terminals (7*a*, 7*b*);

an elongated antenna conductor (3*a*) secured on the supporting piece;

an output transmission line (8) having a first section (14) which is connected to said output terminals (7*a*, 7*b*) and has a length (20) introducing a nonnegligible impedance for high frequencies between one of said output terminals (7*b*) and a ground contact (10), said input terminals (6*a*, 6*b*) being respectively connected to said first mentioned elongated antenna conductor (3*a*) and to said first section (14) of said output transmission line (8), said output transmission line (8) having a second section (15) which is connected to said ground contact (10) and also to an inner connector (11*a*) of said first section (14) of said output transmission line (8), said inner connector (11*a*) is connected to another of said output terminals (7*a*), said one output terminal (7*b*) being connected with said ground contact (10), said active four terminal network (5) including a difference amplifier connected for suppressing in-phase signals;

two L-shaped conductive strips (13) symmetrically arranged in corner areas of said supporting piece and being connected to said input terminals of said active four terminal network.

* * * * *